US005350049A

United States Patent [19]

Ahls et al.

[11] Patent Number: 5,350,049

[45] Date of Patent: Sep. 27, 1994

[54] WEAR RESISTANT SAFETY COATING FOR PEOPLE MOVING DEVICE TREADPLATES

[75] Inventors: Hermann W. Ahls, Vehlen; Michael Kruse, Minden; Peter Borchers, Alfeld, all of Fed. Rep. of Germany

[73] Assignee: Otis Elevator Company, Farmington, Conn.

[21] Appl. No.: 92,173

[22] Filed: Jul. 15, 1993

[51] Int. Cl.[5] ..... B66B 23/12

[52] U.S. Cl. ..... 198/333

[58] Field of Search ..... 198/321, 324, 325, 327, 198/333

[56] References Cited

U.S. PATENT DOCUMENTS 3,144,118 8/1964 Fabula .

FOREIGN PATENT DOCUMENTS

| | | | |
|---|---|---|---|
| 0041377 | 3/1977 | Japan | 198/333 |
| 0041379 | 3/1977 | Japan | 198/333 |
| 0041381 | 3/1977 | Japan | 198/333 |
| 52-75781 | 6/1977 | Japan | B66B 9/12 |
| 52-75782 | 6/1977 | Japan | B66B 9/12 |
| 0124885 | 10/1978 | Japan | 198/333 |
| 0131287 | 10/1979 | Japan | 198/333 |
| 2-86591 | 3/1990 | Japan | B66B 23/00 |
| 0163285 | 6/1990 | Japan | 198/333 |
| 2061215 | 5/1981 | United Kingdom | 198/333 |
| 2087331 | 5/1982 | United Kingdom | 198/333 |
| 2137580 | 10/1984 | United Kingdom | 198/333 |

OTHER PUBLICATIONS

Technical Data Sheet "Color Guard TM Tough Rubber Coating" Permatex® Industrial, Newington, Conn., May 1993.

*Primary Examiner*—D. Glenn Dayoan

[57] ABSTRACT

A treadplate for a people moving device is provided having a tread surface with a plurality of ribs extending out from the tread surface, and a wear resistant polymeric coating, having a color, bonded to the treadplate. The polymeric coating being made of a thermal setting plasticized polyvinylchloride plastic.

9 Claims, 3 Drawing Sheets

*fig. 3*
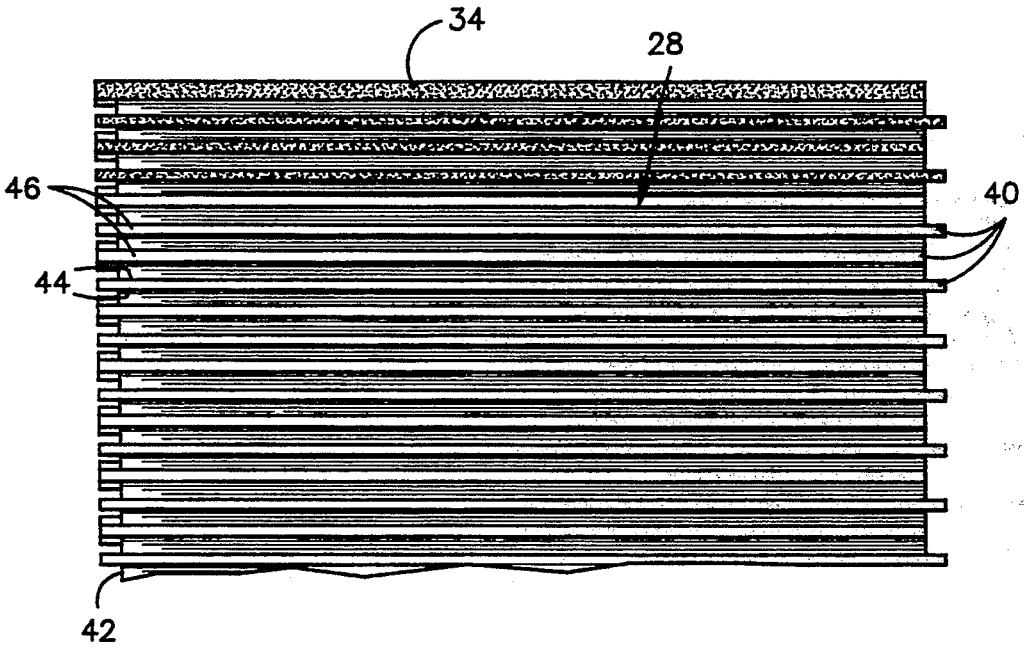
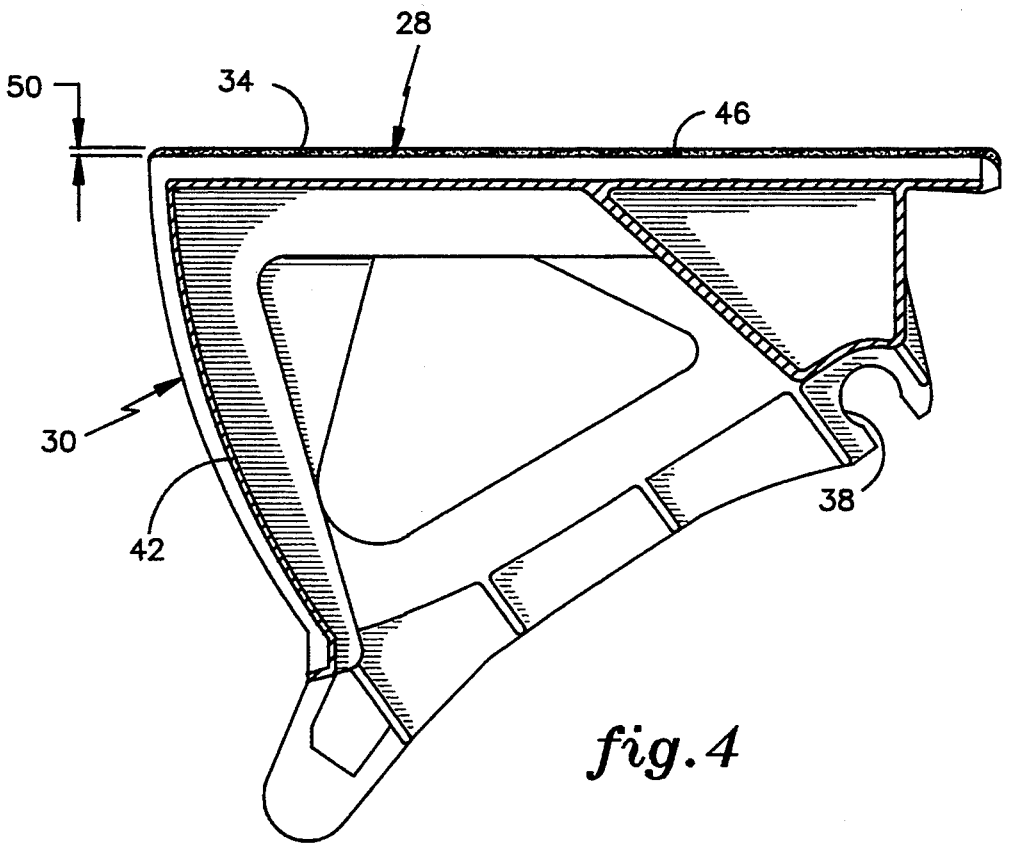
*fig. 4*

WEAR RESISTANT SAFETY COATING FOR PEOPLE MOVING DEVICE TREADPLATES

BACKGROUND OF THE INVENTION

1. Technical Field

The present invention relates to people moving devices in general, and to treadplates for people moving devices in particular.

2. Background Art

Escalators, moving walkways, and other people moving devices efficiently move a large volume of pedestrian traffic from one point to another. Passengers step on moving treadplates (or belts, or pallets, or steps, etc.) and are transported along at a constant rate of speed.

The treadplates are attached to a step chain which travels in a closed loop from a first landing of the people moving device to a second landing and back. Specifically, the treadplates exit the first landing and travel exposed from the first landing to the second landing. From there, the steps reverse direction within the second landing and return to the first landing concealed within the frame of the device. Finally, the steps reverse direction within the first landing, thereby completing the loop.

A person of ordinary skill in the art will recognize that safety is a significant concern in the entry and exit points of a people moving device. Passengers go from stepping on a surface at a zero velocity to stepping on a surface at a constant velocity greater than zero. As a result, there is an opportunity for a passenger to lose his or her balance.

Numerous solutions have been offered to address these safety concerns. In some cases, for example, caution signs are deployed near the entry and exit points. These signs must be positioned out of the moving path, however, or they too become a safety hazard. Positioning the signs out of the moving path decreases the effectiveness of the warning and detracts aesthetically. In other cases, cautionary colors are painted on either the treadplates or the landing entry (typically called the combplate) to highlight the difference in velocity between the parts. The difficulty with a painted coating is that the paint wears off relatively quickly, and therefore increases maintenance costs as well as creates an aesthetic blemish. In still other instances, the treadplates are machined to accept cautionary colored plastic inserts which are typically riveted to the step. A disadvantage of this approach is that the machining process significantly increases the cost of the treadplates. In addition, if the insert works free from the treadplate, the now loose insert and the machined treadplate become a safety hazard. Another disadvantage of machining the step is that the plastic insert cannot be attached to the forward edge of the treadplate. The machining step necessary to make room for the insert would require more stock than is normally cast in the treadplate.

In short, what is needed is a durable means for alerting passengers of the difference in surface velocity at the entry and exit points of a people moving device, which is easily recognizable.

DISCLOSURE OF THE INVENTION

It is, therefore, an object of the present invention to provide a safety device which alerts passengers to the difference in surface velocity at the entry and exits points of a people moving device which is wear resistant.

It is a further object of the present invention to provide a safety device which alerts passengers to the difference in surface velocity at the entry and exit points of a people moving device, which is easily recognized.

According to the present invention, a treadplate for a people moving device is provided having a tread surface with a plurality of ribs extending out from the tread surface, and a wear resistant polymeric coating, having a color, bonded to the treadplate.

According to one aspect of the present invention the wear resistant coating comprises a cautionary color.

According to still another aspect of the present invention, the treadplate further comprises a riser attached to the forward edge of the tread surface.

An advantage of the present invention, is the wear resistant nature of the polymeric coating. The polymeric coating has a longer service life than does any of the prior art solutions. As a result, the maintenance of the escalator treadplates is minimized.

A further advantage of the present invention is the polymeric coating may be brightly pigmented with a cautionary color, thereby highlighting the entry and exit areas of the people moving device.

A still further advantage of the present invention is that the present invention may be positioned in the direct path of the passenger. As a result, the safety alert is more apparent to passengers.

These and other objects, features and advantages of the present invention will become more apparent in light of the detailed description of the best mode embodiment thereof, as illustrated in the accompanying drawings.

BRIEF DESCRIPTION OF THE DRAWINGS

FIG. 3 is a partial top view of an escalator treadplate.

FIG. 4 is a side view of an escalator treadplate.

BEST MODE FOR CARRYING OUT THE INVENTION

Figure 1:
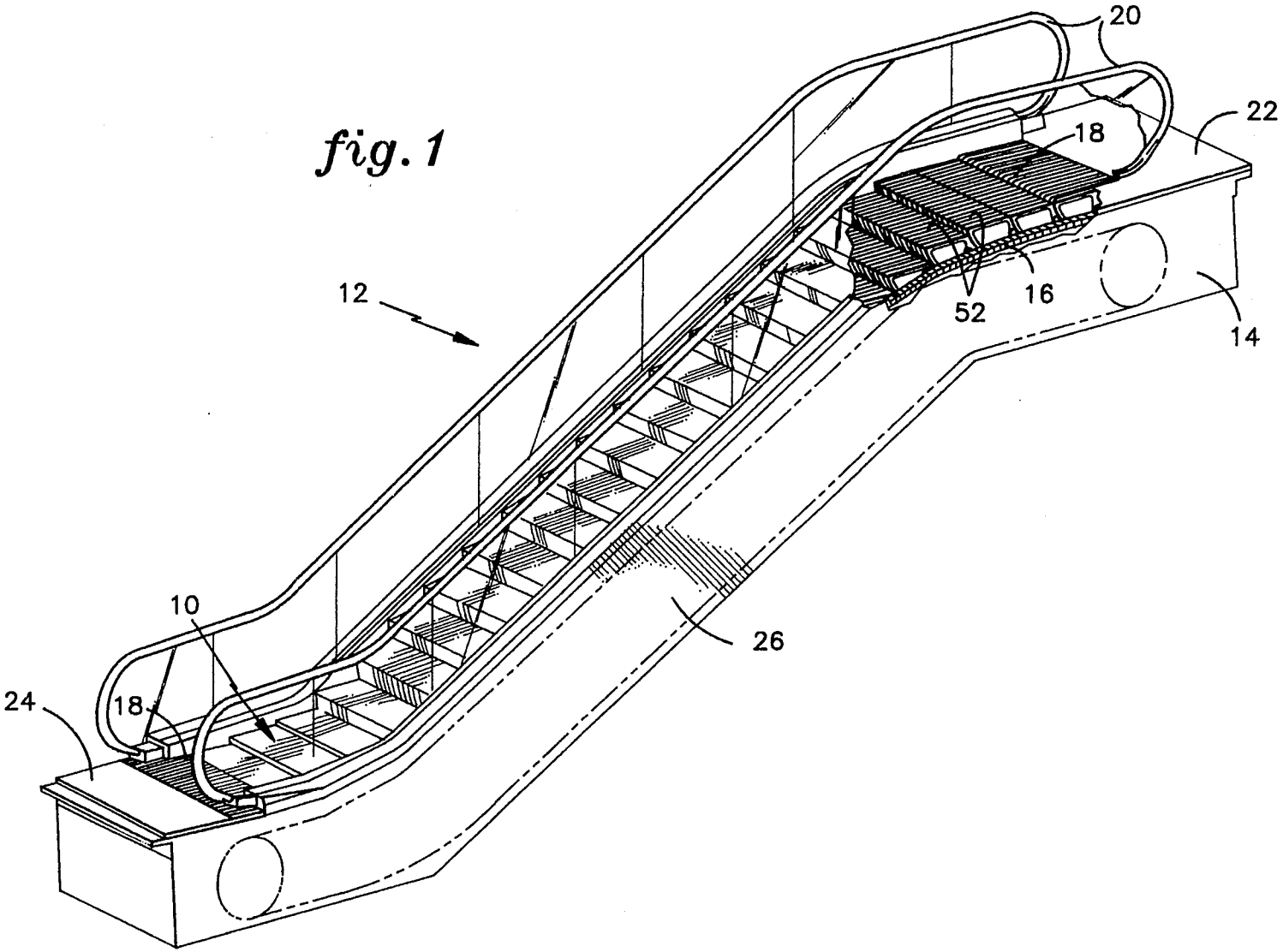
FIG. 1 is a perspective view of an escalator.

Referring the FIG. 1, a plurality of treadplates 10 for a people moving device are shown mounted on escalator 12. The escalator 12 comprises a frame 14, a drive (not shown), a step chain 16, a pair of combplates 18, and a pair of balustrade assemblies 20. The frame 14 comprises a first landing 22 and second landing 24 connected to one another by an inclined midsection 26. The drive propels the step chain 16 in a closed loop path (shown in phantom—see FIG. 1) from one landing 22, 24 to the other 24, 22 and back. The step chain 16 includes a pair chain strands (not shown) connected to one another by axles (not shown). The tread plates 10, attached to the axles, are driven around the same closed loop path as the step chain 16.

Figure 2:
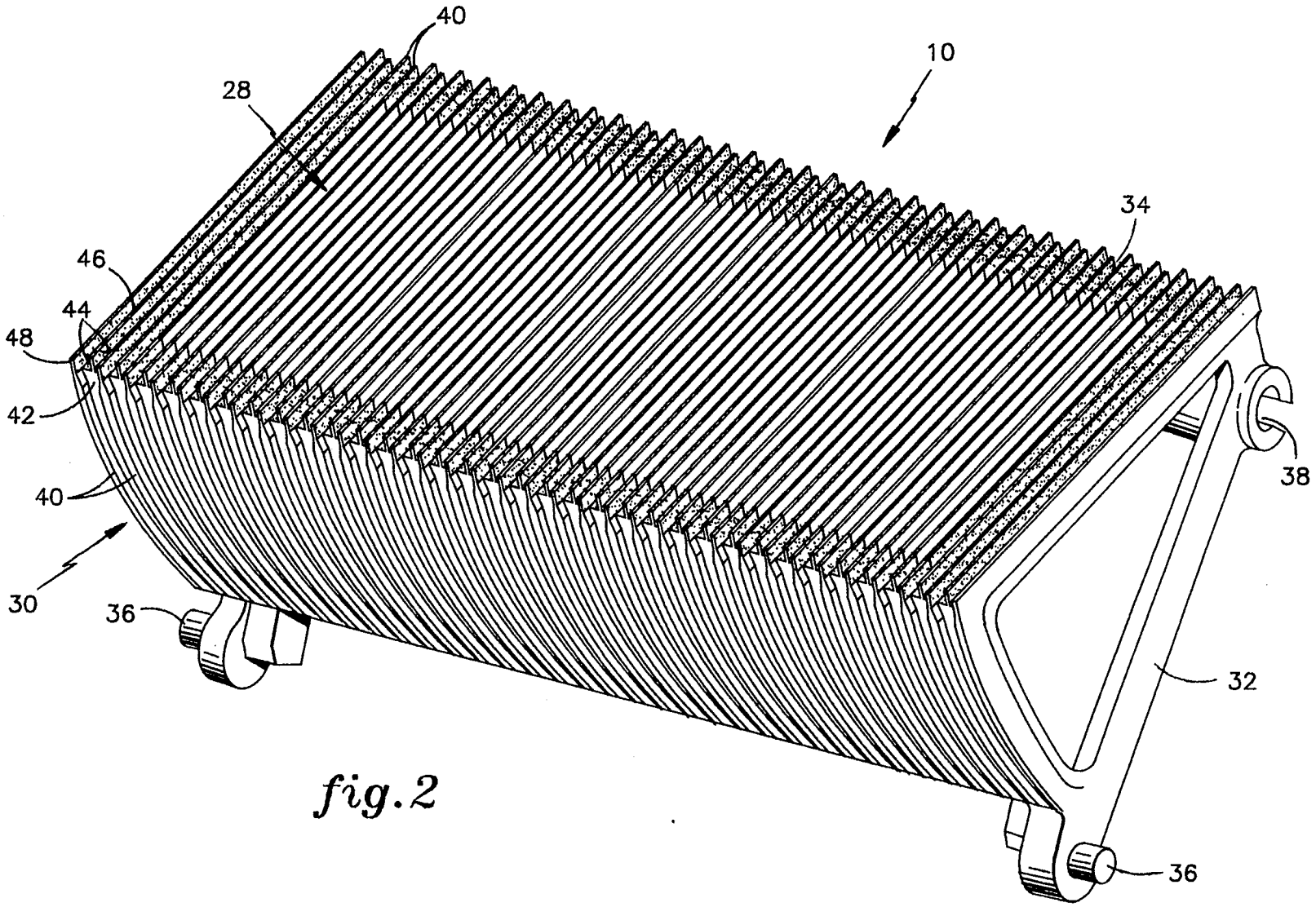
FIG. 2 is a perspective view of an escalator treadplate.

Now referring to FIG. 2, a person of ordinary skill in the art will recognize that each treadplate 10 has a tread surface 28, a riser section 30, a support frame 32, and a wear resistant coating 34 bonded to sections of the tread surface 28. The support frame 32 includes a pair of stub axles 36 for mounting rollers (not shown) and a pair of aligned sockets 38 for receiving a step axle. The tread surface 28 and the riser section 30 both have a plurality of ribs 40 extending out from a body 42. Each rib 40 has a body defined by two side surfaces 44 and an outer surface 46 (see also FIG. 3). The ribs 40 on the tread surface 28 and riser section 30 are parallel to and offset from one another to avoid interference between each treadplate 10.

The wear resistant coating 34 is a plasticized polyvinyl chloride (PVC-P). A person of ordinary skill in the art will recognize, however, that other polymers, elastomers, or rubber products, may be used alternatively. The PVC-P coating is bonded to sections of the tread surface 28 using a dipping process which begins by applying a primer to the section of the tread surface 28 to be coated; i.e. applying the primer to only outer surfaces 46 of the ribs 40 will cause the coating 34 to bond to only the outer surfaces 46. A person of ordinary skill in the art will recognize that the primer may be any one of a number of different phenolic/epoxy based resins with a hydrocarbon solvent. In the preferred en%bodiment, the coating 34 is applied to the outer surfaces 46 of the ribs 40 along the entire periphery of the tread surface 28, including the edge 48 adjacent to the riser section 30 (see FIG. 2), also called the forward edge of the tread plate. In the next step of the dipping process, the treadplate 10 is heated and dipped into a bath of liquid PVC-P (not shown). The thickness 50 of the coating 34 bonded to the tread surface 28 (see FIG. 4) increases as a function of time. Hence, the thickness 50 of the coating 34 can be manipulated by varying the amount of time a particular section of the tread surface 28 is exposed to the bath.

The polymeric coating 34 may be manufactured in a wide variety of colors. In a preferred en%bodiment, the coating 34 assumes a bright yellow or orange color (see FIG. 3) which is customarily used to warn of a safety hazard.

Referring to FIG. 1, in the operation of the escalator 12, the escalator drive propels the step chain 16 and attached treadplates 10 in a closed loop, from one landing 22, 24 to the other landing 24, 22 and back. As the treadplates 10 pass from the inclined midsection 26 to one of the landings 22, 24, the difference in height between the treadplates 10 decreases until the tops 52 of the treadplates 10 in the landing 22, 24 are at the same height. In other words, the treadplate tops 52 become co-planar. Subsequently, the co-planar treadplates 10 traveling through the landing 22, 24 enter the enclosed portion of the landing 22, 24 through the combplate 18. Alternatively, the co-planar treadplates 10 emerge from the enclosed portion of the landing 22, 24 underneath the combplate 18 and travel towards the inclined midsection 26. Either way, the treadplates 10 are moving at a constant velocity greater than zero relative to the combplate 18. The brightly colored coating 34 bonded to the combplate 18 draws the passenger's attention to the difference in velocities, and consequently allows the passenger (not shown) to safely enter and exit the escalator 12.

Although this invention has been shown and described with respect to the detailed embodiments thereof, it will be understood by those skilled in the art that various changes in form and detail thereof may be made without departing from the spirit and scope of the claimed invention.

We claim:

1. A treadplate for conveying passengers in a passenger conveying device, comprising:

a tread surface, having a body defined by a width and a length, wherein said length extends in the direction of travel of said treadplate; and a wear resistant coating, bonded to said tread surface, said coating comprising a thermal setting plasticized polyvinylchloride plastic.

2. A treadplate for a passenger conveying device according to claim 1, wherein said tread surface further comprises:

a plurality of ribs, extending out from said body and lengthwise across said tread surface, wherein each said rib includes a body defined by a pair of side surfaces and a top surface, said top surface positioned to permit contact with a passenger;

wherein said wear resistance coating is bonded to said side surfaces of said ribs and said body of said tread surface.

3. A treadplate for a passenger conveying device according to claim 2, wherein said wear resistant coating is bonded to said top surfaces of said ribs, and therefore positioned to permit contact with said passengers.

4. A passenger conveying device, comprising:

a plurality of treadplate for conveying passengers within said passenger conveying device, wherein each said treadplate comprises:

a tread surface, having a body defined by a width and a length, wherein said length extends in the direction of travel of said treadplate; and a wear resistant coating, bonded to said tread surface, said coating comprising a thermal setting plasticized polyvinylchloride plastic.

5. A passenger conveying device according to claim 4, wherein said tread surface further comprises:

a plurality of ribs, extending out from said body and lengthwise across said tread surface, wherein each said rib includes a body defined by a pair of side surfaces and a top surface, said top surface positioned to permit contact with a passenger;

wherein said wear resistant coating is bonded to said side surfaces of said ribs and said body of said tread surface.

6. A passenger conveying device according to claim 5, wherein said wear resistant coating is bonded to said top surfaces of said ribs, and therefore positioned to permit contact with said passengers.

7. An escalator, comprising:

a plurality of steps for conveying passengers, wherein each said step comprises:

a tread surface, having a body defined by a width and a length, wherein said length extends in the direction of travel of said step; and a wear resistant coating, bonded to said tread surface, said coating comprising a thermal setting plasticized polyvinylchloride plastic.

8. An escalator according to claim 7, wherein said tread surface further comprises:

a plurality of ribs, extending out from said body and lengthwise across said tread surface, wherein each said rib includes a body defined by a pair of side surfaces and a top surface, said top surface positioned to permit contact with a passenger;

wherein said wear resistant coating is bonded to said side surfaces of said ribs and said body of said tread surface.

9. A passenger conveying device according to claim 8, wherein said wear resistant coating is bonded to said top surfaces of said ribs, and therefore positioned to permit contact with said passengers.

* * * * *